US010901369B2

(12) United States Patent
Tamura et al.

(10) Patent No.: US 10,901,369 B2
(45) Date of Patent: Jan. 26, 2021

(54) ELECTRONIC TIMEPIECE

(71) Applicant: Seiko Epson Corporation, Tokyo (JP)

(72) Inventors: Shuichi Tamura, Matsumoto (JP); Toshikazu Akiyama, Matsumoto (JP)

(73) Assignee: Seiko Epson Corporation

( * ) Notice: Subject to any disclaimer, the term of this patent is extended or adjusted under 35 U.S.C. 154(b) by 365 days.

(21) Appl. No.: 16/048,713

(22) Filed: Jul. 30, 2018

(65) Prior Publication Data

US 2019/0033786 A1 Jan. 31, 2019

(30) Foreign Application Priority Data

Jul. 31, 2017 (JP) ..... 2017-147699

(51) Int. Cl.
*G04B 19/247* (2006.01)
*G04B 19/253* (2006.01)

(52) U.S. Cl.
CPC ..... *G04B 19/253* (2013.01)

(58) Field of Classification Search
CPC G04B 19/25; G04B 19/253; G04B 19/25306; G04B 19/25313
See application file for complete search history.

(56) References Cited

U.S. PATENT DOCUMENTS 4,470,706 A * 9/1984 Nishimura ..... G04C 3/14 368/251
5,339,293 A * 8/1994 Kamiyama ..... G04B 19/235 368/110
2014/0301170 A1* 10/2014 Tran ..... G04B 19/25333 368/37

FOREIGN PATENT DOCUMENTS

JP 61-067589 U 5/1986
JP 04-124494 U 11/1992
JP 2011-191220 A 9/2011

* cited by examiner

*Primary Examiner* — Sean Kayes
(74) *Attorney, Agent, or Firm* — Hamess, Dickey & Pierce, P.L.C.

(57) ABSTRACT

An electronic timepiece can eliminate deviation in the information display position of two display wheels. An electronic timepiece has: a first display wheel having numerals indicating the ones digit of the date; and a second display wheel having numerals indicating the tens digit of the date. At least one of the display wheels can be turned in a first direction and a second direction. A controller, when turning the display wheel in the first direction, executes a first rotation process of turning the display wheel in the first direction and then stopping rotation of the display wheel; and when turning the display wheel in the second direction, executes a second rotation process of turning the display wheel in the second direction, then turning the display wheel in the first direction, and then stopping rotation of the display wheel.

6 Claims, 10 Drawing Sheets

ELECTRONIC TIMEPIECE

BACKGROUND

1. Technical Field

The present invention relates to an electronic timepiece.

3. Related Art

Japan Unexamined Utility Model Specification 1992-124494 describes an electronic timepiece that drives a display wheel such as a date wheel or day wheel with a motor and wheel train, and can drive the motor in both forward and reverse directions.

By turning the drive wheel a specific angle in reverse after the display wheel stops, the timepiece described in Japan Unexamined Utility Model Specification 1992-124494 accounts for backlash by returning the position of the teeth of the drive wheel to an intermediate position between two teeth of the display wheel. As a result, movement of the stopped display wheel can be minimized in the event of a physical impact on the electronic timepiece, preventing misalignment of content printed on the display wheel shown in the display window.

However, when the display wheel turns in a first direction and then stops, and when the display wheel turns in a second direction, which is the opposite of the first direction, and then stops in this electronic timepiece, the position of the display wheel may shift due to the effects of backlash. Because only the drive wheel turns after the display wheel stops in this electronic timepiece, and the display wheel is held in the stopped position, the offset in the position of the display wheel in the direction of rotation remains.

This offset in the position of the display wheel is particularly conspicuous in the case of a big date display that expresses a single date by aligning a display wheel that indicates the tens digit of the date and a display wheel that indicates the ones digit of the date. In other words, because the numbers on two display wheels are aligned to indicate a single date in a big date display, the offset of the display position is particularly noticeable, and detracts from the appearance.

When displaying a single date with two display wheels, an electronic timepiece according to the invention reduces the offset in the positions of the two display wheels when stopped, even when at least one of the display wheels turns either the first direction or second direction.

SUMMARY

An electronic timepiece according to a preferred aspect of the invention includes: a first display wheel having numerals indicating the ones digits of the date; a second display wheel having numerals indicating the tens digits of the date; a first drive mechanism configured to turn the first display wheel; a second drive mechanism configured to turn the second display wheel; and a controller configured to control the first drive mechanism and second drive mechanism. The first drive mechanism or second drive mechanism is configured to turn the display wheel in a first direction and a second direction that is the reverse of the first direction. The controller, when turning the display wheel in the first direction, executes a first rotation process of turning the display wheel in the first direction and then stopping rotation of the display wheel; and when turning the display wheel in the second direction, executes a second rotation process of turning the display wheel in the second direction, then turning the display wheel in the first direction, and then stopping rotation of the display wheel.

In this aspect of the invention, when of the first display wheel and second display wheel the display wheel that can turn in both a first direction and a second direction turns in the second direction, the controller executes a second rotation process that turns the display wheel in the second direction, then turns the display wheel in the first direction, and then ends the rotation process. By executing a first rotation process that turns the display wheel in the first direction, and a second rotation process that turns the display wheel in the second direction, this configuration turns both display wheels in the first direction before ending the rotation process, and can thereby prevent the display position of the display wheel shifting due to differences in the direction of rotation.

More specifically, the drive mechanism that causes the display wheel to turn normally comprises a stepper motor and wheel train. The wheel train comprises multiple wheels that mesh together, and transfer drive power from the stepper motor. There is a small gap referred to as backlash between the teeth of the wheels.

Backlash is an amount of play between the teeth that allows a pair of meshed wheels to turn smoothly, absorbs manufacturing deviations and thermal expansion of the parts of the wheel train (including the wheels, plates and bridges supporting the wheels, and bearings), and prevents obstructing wheel rotation and damage to the wheel train.

Because of this backlash between the tooth faces of the wheels, the display position of the display wheel may differ slightly depending upon whether the display wheel turns in the first direction or turns in the second direction. As a result, in the second rotation process, the display wheel is first turned a specific amount in the second direction, then turned a further amount in the second direction, and is then turned in the first direction. This means that in both the first rotation process and second rotation process, the display wheel last turns in the first direction before the rotation process ends. Deviation in the display positions of the numerals shown on the first display wheel that show through a first display window, and the numerals shown on the second display wheel that show through a second display window, can therefore be reduced. The luxury appearance of the electronic timepiece can therefore be maintained.

Furthermore, because the date is displayed by two date indicators, the first display wheel and the second display wheel, a big date complication that displays the date with larger numerals than when the date is indicated by the a single date wheel can be achieved.

In addition, because the user reads the two numbers indicated by the two date indicators as a single date, deviation in the display position of the two numbers is conspicuous, and detracts from the appearance of the electronic timepiece. However, because the invention can prevent deviation in the display positions of the date numerals, the electronic timepiece can be given the look of a luxury watch.

Furthermore, because deviation in the display position due to the direction of rotation of the display wheels is eliminated, the date can be adjusted by turning the display wheel in the direction requiring the smallest adjustment amount (angle of rotation). Power consumption when adjusting the display wheels can therefore be reduced, and the display can be adjusted in less time.

Preferably in an electronic timepiece according to another aspect of the invention, the first drive mechanism or the second drive mechanism has a driving wheel that meshes with a wheel disposed to the display wheel; the driving wheel, when turning in a first driving direction, causes the display wheel to turn in the first direction, and when turning in a second driving direction, causes the display wheel to turn in the second direction. The controller, when executing the second rotation process, drives the driving wheel to turn in the second driving direction an amount of rotation equal to a correction amount required to turn the driving wheel and adjust a display by the display wheel, plus a display correction amount required to compensate for variation of backlash, and then drives the driving wheel to turn in the first driving direction an amount of rotation equal to a backlash correction amount plus the display correction amount. The backlash correction amount is set based on backlash between a wheel of the display wheel and the driving wheel, and the display correction amount is set so the amount of rotation equal to the backlash correction amount plus the display correction amount is greater than the maximum backlash.

Positioning deviation due to the direction of rotation of the display wheel is, as described above, affected by backlash in the wheel train, and the effect of backlash between the gears of the display wheel and the driving wheel that meshes with those gears (wheels) is greatest. As a result, the backlash correction amount to compensate for deviation in the position of the display wheel due to backlash may be set based on the backlash between the wheel of the display wheel and the driving wheel. In addition, backlash correction also varies due to manufacturing deviations in the parts. Backlash correction is therefore set based on the typical amount of backlash (such as the median, average, or most frequent value).

As described above, the display correction amount compensates for variation in backlash due to manufacturing variations in the parts. That is, if the driving wheel is turned only the backlash correction amount in the first driving direction to compensate for backlash after turning the driving wheel in the second driving direction and turning the display wheel a specific amount in the second direction, and the backlash between the meshed teeth is greater than the backlash correction amount due to the manufacturing tolerances, the teeth of the driving wheel may not contact the teeth of the display wheel, and correcting the position of the display wheel may not be possible, even if the driving wheel turns only the backlash correction amount in the first driving direction.

Therefore, the display correction amount is set so that the sum of the display correction amount and backlash correction amount is greater than the maximum backlash deviation. Then, by turning the driving wheel in the first direction an amount equal to the sum of the backlash correction amount and display correction amount, the effect of deviation in the backlash can be cancelled, and deviation in the position of the display wheel due to backlash can be reliably corrected. For example, when backlash is expressed by the number of drive pulses (pulse count) of the driving wheel, and the backlash correction pulse count is 4 pulses and the maximum backlash is 6.2 pulses, the display correction amount is set to 3 pulses or more, and in one example is set to 4 pulses.

In the invention, when the second rotation process executes, the driving wheel that meshes with a wheel of the display wheel is turned in the second driving direction an amount equal to the sum of the correction amount required to correct the display of the display wheel, plus the display correction amount. As a result, the display wheel turns in the second direction and overruns the target position after adjustment.

The controller then turns the driving wheel in the first driving direction an amount equal to the sum of the backlash correction amount and the display correction amount. The position of the driving wheel that turned in the second driving direction is offset by the backlash from the driving wheel turning in the first driving direction, but the difference in backlash is compensated for by turning only the backlash correction amount in the first driving direction.

Furthermore, because the driving wheel turns only the display correction amount in the first driving direction, the display wheel can be turned in the first direction, and returned to the target position after the adjustment. Therefore, the position of the display wheel resulting from the second rotation process can be reliably set to the position of the display wheel from the first rotation process. In addition, because the display correction amount is set so that the amount of rotation equal to the sum of the backlash correction amount and the display correction amount is greater than the maximum backlash, the display wheel can be reliably turned the display correction amount in the first direction and second direction even if backlash varies.

Further preferably in an electronic timepiece according to another aspect of the invention, the controller, after ending the first rotation process or ending the second rotation process, causes the driving wheel to turn half the backlash correction amount in the second driving direction.

In this aspect of the invention, because the driving wheel turns half the backlash correction amount in the second driving direction after the first rotation process or second rotation process ends, a tooth of the driving wheel is positioned midway between teeth of the display wheel.

When the driving wheel stops engaged with the wheel of the display wheel, and a shock is then applied to the electronic timepiece, the display wheel can move up to the backlash distance, and deviation in the display position increases.

However, because a tooth of the driving wheel is positioned midway between teeth of a wheel of the display wheel, the gap between the teeth is half the backlash. As a result, when an impact is applied to the electronic timepiece, displacement of its position can be reduced regardless of the position the display wheel turns.

Further preferably, an electronic timepiece according to another aspect of the invention also has an operating member; the controller is configured to execute a reference position adjustment mode adjusting a reference position of the first display wheel or the second display wheel; and the first drive mechanism or the second drive mechanism, when in the reference position adjustment mode, executes the first rotation process or the second rotation process, and adjusts the reference position of the display wheel, based on operation of the operating member.

Because this aspect of the invention has a reference position adjustment mode that adjusts the reference position of the display wheel, the display position of numerals on the display wheels shown through the display windows can be adjusted by the user manipulating the crown, button, or other operating means. As a result, the user can precisely adjust the position of displayed information to the position desired by the user in the display window, and user convenience can be improved for the user of the electronic timepiece.

Furthermore, because the first rotation process and second rotation process execute when adjusting the reference position, the reference position can be adjusted more quickly than when the display wheel can be turned in only one direction. Furthermore, because the first rotation process and second rotation process also execute when adjusting the reference position, deviation in the display position due to backlash and the direction of rotation can be prevented when the display wheel is turned in the first direction to adjust the reference position, and when the display wheel is turned in the second direction to adjust the reference position. Adjustment to the same reference position is therefore possible regardless of whether the display wheel turns in the first direction or the second direction.

Further preferably in an electronic timepiece according to another aspect of the invention, the first drive mechanism is configured to turn the first display wheel in the first direction and the second direction; the second drive mechanism is configured to turn the second display wheel in the first direction and the second direction; and the controller, when adjusting the date indicated by the first display wheel and the second display wheel to the current date, determines the adjustment direction requiring the least rotation of the first display wheel and second display wheel, executes the first rotation process if the adjustment direction is the first direction, and executes the second rotation process if the adjustment direction is the second direction.

Thus comprised, the first display wheel and second display wheel are driven the shortest adjustment amount when turning to set the current date. As a result, power consumption can be reduced when adjusting the first display wheel and second display wheel, and adjustment can be completed in less time.

Further preferably in an electronic timepiece according to another aspect of the invention, the first drive mechanism includes a first stepper motor and a first wheel train; the second drive mechanism includes a second stepper motor and a second wheel train; and the controller outputs drive pulses to the first or second stepper motor to execute the first rotation process and the second rotation process.

Thus comprised, because the controller controls the number of drive pulses output to the stepper motor to execute the first rotation process and second rotation process, control can be simplified.

Other objects and attainments together with a fuller understanding of the invention will become apparent and appreciated by referring to the following description and claims taken in conjunction with the accompanying drawings.

DESCRIPTION OF EMBODIMENTS

A preferred embodiment of the present invention is described below with reference to the accompanying figures.

Below, when the electronic timepiece 1 is worn on the wrist, the surface side in contact with the arm (wrist) (that is, the back cover side of the electronic timepiece 1) is referred to as the back of the electronic timepiece 1, and the opposite side (that is, the crystal side of the electronic timepiece 1) is referred to as the front of the electronic timepiece 1.

Figure 1:
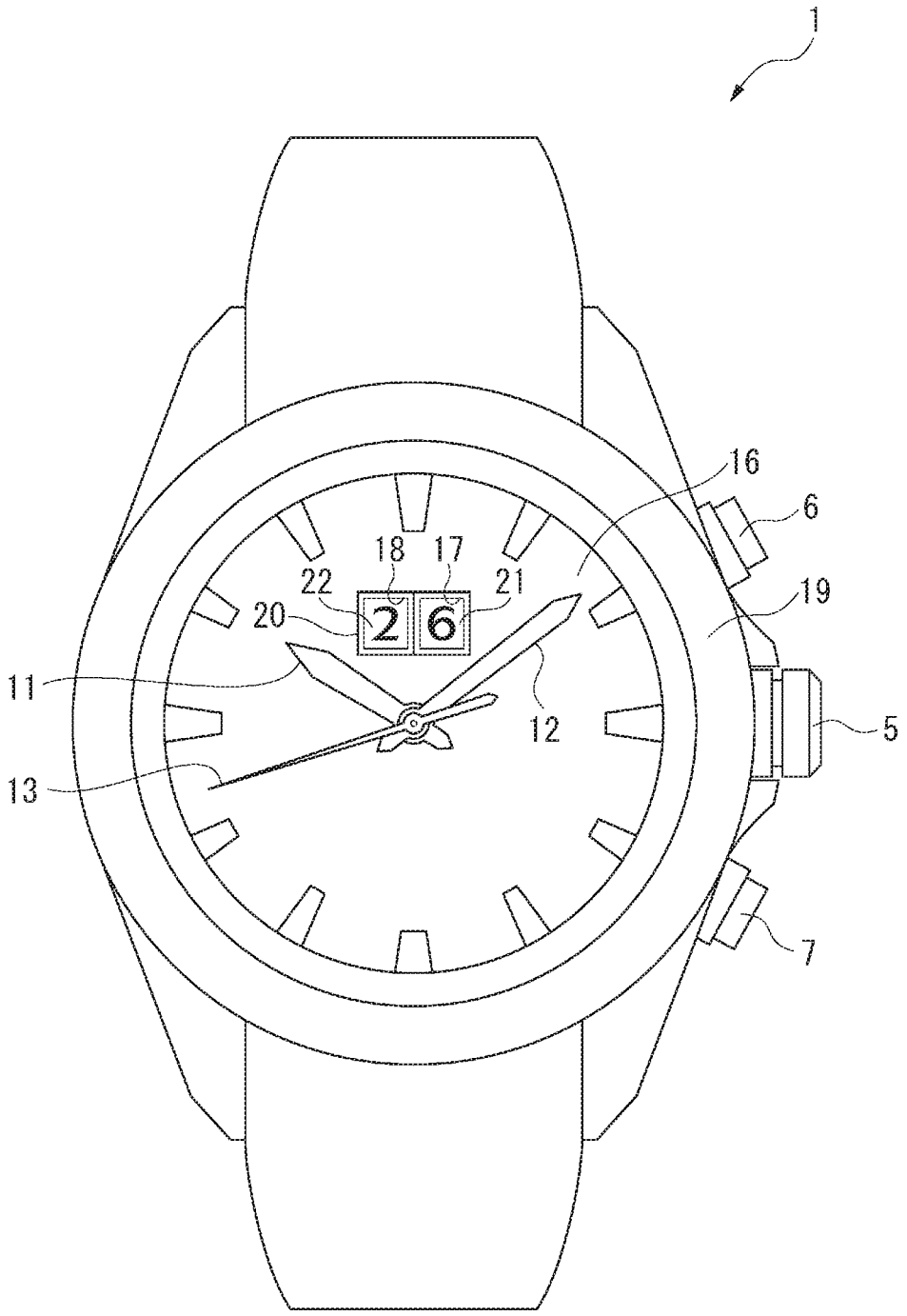
FIG. 1 is a plan view of an electronic timepiece according to a preferred embodiment of the invention.

As shown in FIG. 1, the electronic timepiece 1 has an hour hand 11, a minute hand 12, a second hand 13, a dial 16, a ones date indicator 21, and a tens date indicator 22.

The dial 16 is on the front side of the ones date indicator 21 and tens date indicator 22, and has a ones window 17 as an example of a first display window, and a tens window 18 as an example of a second display window. The ones date indicator 21, which shows the ones value of the date in the ones window 17, is an example of a first display wheel, and the tens date indicator 22, which shows the tens value of the date in the tens window 18, is an example of a second display wheel in the accompanying claims.

The electronic timepiece 1 also has a case 19, and a movement 10 (see FIG. 2) housed inside the case 19, and is a wristwatch that the user wears on the wrist. The electronic timepiece 1 also has a crown 5, A button 6, and B button 7 as operating members.

Figure 2:
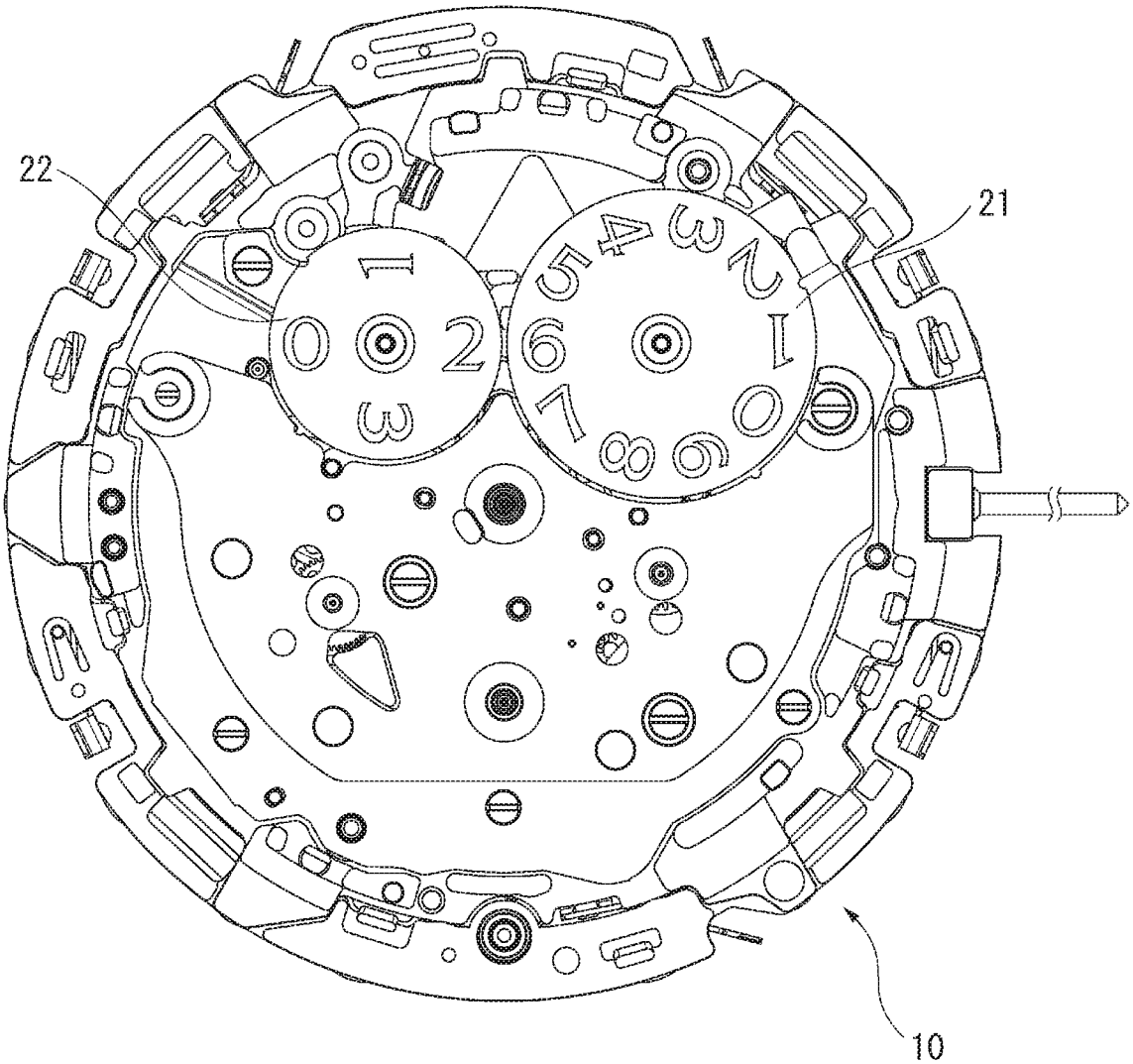
FIG. 2 shows the movement of the electronic timepiece.

FIG. 2 shows the movement 10. The ones date indicator 21 is a round disc with the numbers 0 to 9 displayed in counterclockwise order around the outside edge. When the date changes during normal operation, the ones date indicator 21 turns 36 degrees clockwise as seen in FIG. 2 to advance the date one day (such as from 6 to 7).

The tens date indicator 22 is also a round disc, and has the numbers 0 to 3 displayed in clockwise order around the outside edge. When the date changes during normal operation, the tens date indicator 22 changes the tens digit of the date, turning 90 degrees counterclockwise every ten days, that is, when the date indicated by the ones date indicator 21 changes from 9 to 0, and at the end of the month when the date advances to the first (1), and turning 180 degrees when the date advances from the last day in February to March 1.

Because the number of digits displayed by the ones date indicator 21 is greater than the tens date indicator 22, the diameter of the ones date indicator 21 is larger than the diameter of the tens date indicator 22.

As shown in FIG. 1, the date windows 17 and 18 are positioned centered on a line between the axis of rotation of the ones date indicator 21 and the axis of rotation of the tens date indicator 22. The numbers shown at the adjacent positions of the ones date indicator 21 and tens date indicator 22 are displayed in the date windows 17 and 18.

In this example, the date windows 17 and 18 is configured by a single through-hole rectangular in plan view formed in the dial 16, with a frame 20 around the through-hole. As shown in FIG. 8 described below, the frame 20 comprises a first window frame 201 framing the ones window 17, and a second window frame 202 framing the tens window 18. The first window frame 201 and second window frame 202 are rectangular, and frame the date windows 17 and 18 with rectangles. Two side frame members of the first window frame 201 and second window frame 202 are disposed side by side between the date windows 17 and 18. These two side frame members cover the outside edges of the ones date indicator 21 and tens date indicator 22, and the date windows 17 and 18 are configured so that the outside edges of date indicators 21 and 22 cannot be seen through the date windows 17 and 18.

Note that the date windows 17 and 18 may be formed by two through-holes in the dial 16 with two frames disposed respectively to the through-holes, or one or two date windows 17 and 18 may be formed without a window frame. The shape of the date windows 17 and 18 in plan view is also not limited to rectangular, and the date windows 17 and 18 may have a round, oval, or other shape according to the desired design of the dial 16.

Figure 3:
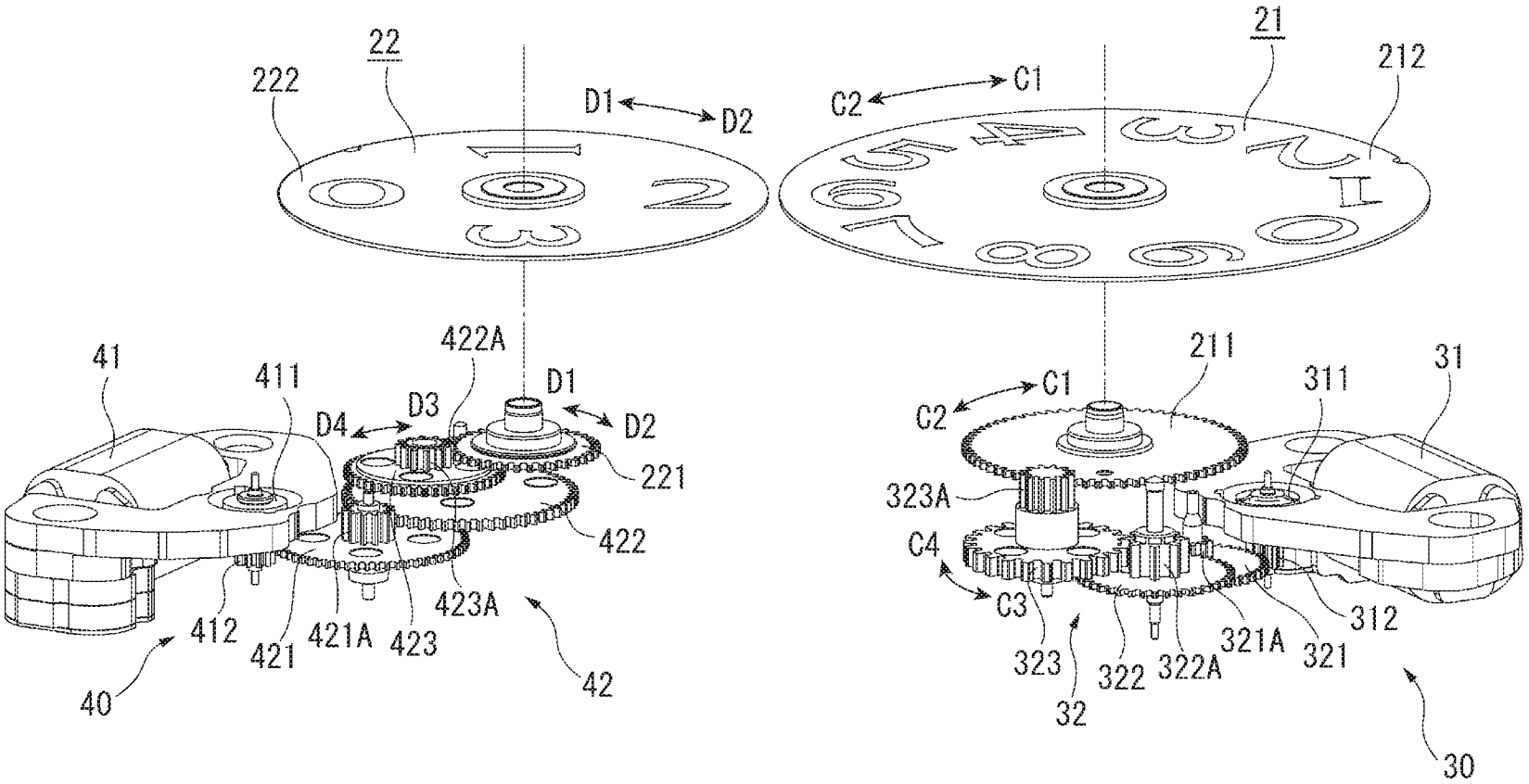
FIG. 3 is an exploded oblique view of the date wheel and drive mechanism of the electronic timepiece.

As shown in FIG. 3, the ones date indicator 21 includes a first wheel 211 and a first date indicator 212 that attaches to the first wheel 211. The numbers 0 to 9 are printed on the first date indicator 212 in this example. The tens date indicator 22 includes a second wheel 221, and a second date indicator 222 that attaches to the second wheel 221. The numbers 0 to 3 are printed on the second date indicator 222 in this example.

First Drive Mechanism

The ones indicator drive mechanism 30, which is a first drive mechanism that drives the ones date indicator 21, is described next. The ones indicator drive mechanism 30 is a drive mechanism that can drive the ones date indicator 21 in both a first direction and a second direction.

As shown in FIG. 3, the ones indicator drive mechanism 30 includes a first motor 31 (a first stepper motor), and a first wheel train 32. The first motor 31 has a rotor 311, and the rotor 311 has a rotor pinion 312.

The first wheel train 32 has a first intermediate wheel 321 that meshes with the rotor pinion 312; a second intermediate wheel 322 that meshes with the pinion 321A of the first intermediate wheel 321; and a third intermediate wheel 323 that meshes with the pinion 322A of the second intermediate wheel 322. The pinion 323A of the third intermediate wheel 323 meshes with the first wheel 211 of the ones date indicator 21. As a result, drive power from the first motor 31 is transferred through the first wheel train 32 to the ones date indicator 21.

The direction in which the ones date indicator 21 turns clockwise is referred to below as the first direction C1, and the direction in which the ones date indicator 21 turns counterclockwise is referred to below as the second direction C2.

The direction of rotation of the rotor 311 of the first motor 31, and the intermediate wheels 321, 322, 323 of the first wheel train 32, when the ones date indicator 21 turns clockwise is referred to as the first driving direction C3, and the opposite direction is referred to as the second driving direction C4.

The direction of the first motor 31 when driving the rotor 311 in the first driving direction C3 is referred to as forward drive (forward rotation), and the direction when driving in the second driving direction C4 is the reverse drive (reverse rotation). The first motor 31 is configured to drive with less power consumption during forward rotation than during reverse rotation.

Second Drive Mechanism

The tens indicator drive mechanism 40, which is a second drive mechanism that drives the tens date indicator 22, is described next. The tens indicator drive mechanism 40 is a drive mechanism that can drive the tens date indicator 22 in both a first direction and a second direction.

As shown in FIG. 3, the tens indicator drive mechanism 40 includes a second motor 41 (a second stepper motor), and a second wheel train 42. The second motor 41 has a rotor 411, and the rotor 411 has a rotor pinion 412.

The second wheel train 42 has a first intermediate wheel 421 that meshes with the rotor pinion 412; a second intermediate wheel 422 that meshes with the pinion 421A of the first intermediate wheel 421; and a third intermediate wheel 423 that meshes with the pinion 422A of the second intermediate wheel 422. The pinion 423A of the third intermediate wheel 423 meshes with the second wheel 221 of the tens date indicator 22. As a result, drive power from the second motor 41 is transferred through the second wheel train 42 to the tens date indicator 22.

The direction in which the tens date indicator 22 turns counterclockwise is referred to below as the first direction D1, and the direction in which the tens date indicator 22 turns clockwise is referred to below as the second direction D2.

The direction of rotation of the rotor 411 of the second motor 41, and the intermediate wheels 421, 422, 423 of the second wheel train 42, when the tens date indicator 22 turns counterclockwise is referred to as the third driving direction D3, and the opposite direction is referred to as the second driving direction D4.

The direction of the second motor 41 when driving the rotor 411 in the first driving direction D3 is referred to as forward drive (forward rotation), and the direction when driving in the second driving direction D4 is the reverse drive (reverse rotation). The second motor 41 is configured to drive with less power consumption during forward rotation than during reverse rotation.

Circuit Configuration of the Electronic Timepiece

Figure 4:
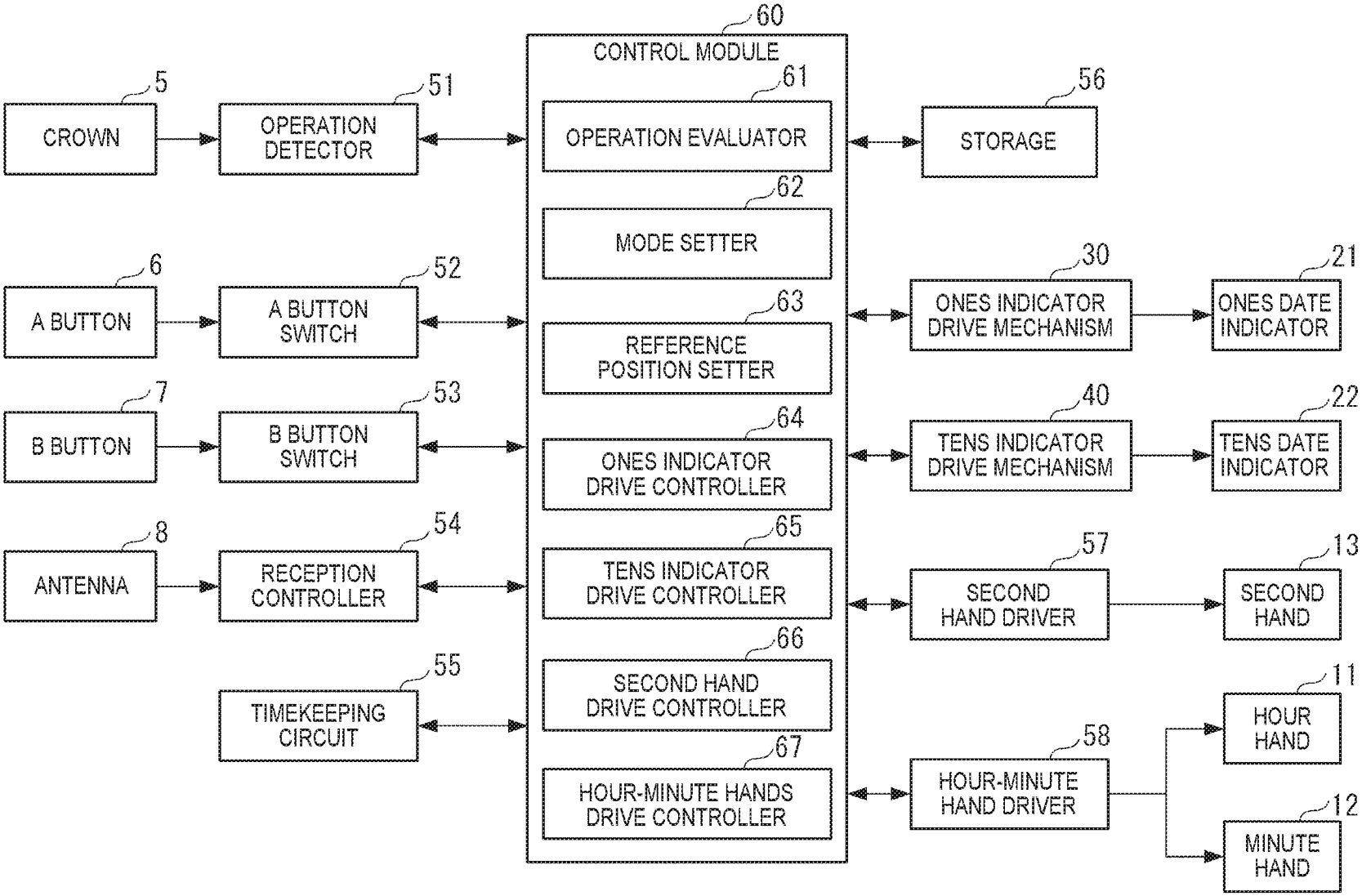
FIG. 4 is a block diagram illustrating the circuit configuration of the electronic timepiece.

FIG. 4 is a block diagram illustrating the circuit configuration of the electronic timepiece 1.

This electronic timepiece 1 has an operation detector 51, A button switch 52, B button switch 53, reception controller 54, timekeeping circuit 55, storage 56, ones indicator drive mechanism 30, tens indicator drive mechanism 40, second hand driver 57, hour-minute hand driver 58, and control module 60.

The operation detector 51 is a switch that detects operation of the crown 5, and is configured to detect whether the stop position of the crown 5 (for example, the zero stop, first stop, or second stop), and the direction and amount of crown 5 rotation. The crown 5 is therefore an electronic switch capable of electrically detecting the stop position, direction of rotation, and amount of rotation.

The A button switch 52 and B button switch 53 are switches that detect when the A button 6 and B button 7 are pushed by the user, and output detection signals to the control module 60.

A electronic timepiece 1 according to this embodiment therefore has an operating means embodied by the crown 5, A button 6, and B button 7, and an operation detection means embodied by the operation detector 51, A button switch 52, and B button switch 53 that detects operation of the operating means.

This electronic timepiece 1 also has an antenna 8 and a reception controller 54. The antenna 8 may be configured to receive radio signals carrying time information. Examples of such radio signals include GPS satellite signals, standard frequency and time signals, and near-field communication signals such as Bluetooth® signals. The type of antenna 8 may be determined according to the type of radio signals to receive, and a ring antenna or planar antenna (patch antenna), for example, may be used to receive GPS satellite signal. In addition, a bar antenna may be used to receive standard frequency and time signals, and a chip antenna may be used to receive near-field communication signals.

The reception controller 54 in this example is a circuit that controls signal reception by the antenna 8. Operation of the reception controller 54 is controlled by the control module 60, and the reception controller 54 outputs time information acquired from the signals received by the antenna 8 to the control module 60.

In this embodiment of the invention a ring antenna housed in the dial ring disposed around the outside of the dial 16 is used as the antenna 8, and the reception controller 54 is configured to receive GPS satellite signals and output the time information acquired from the GPS satellite signals.

The timekeeping circuit 55 updates the time data using a reference signal generated by frequency dividing the oscillation signal from a crystal oscillator.

The storage 56 stores the reference position of the ones date indicator 21 and tens date indicator 22 adjusted by the reference position setter 63 described below.

The second hand driver 57 includes a stepper motor and wheel train not shown, and moves the second hand 13 by driving the stepper motor according to drive pulses input from the control module 60.

The hour-minute hand driver 58 includes a stepper motor and wheel train not shown, and moves the minute hand 12 and hour hand 11 by driving the stepper motor according to drive pulses input from the control module 60.

Control Module

The control module 60 includes a operation evaluator 61, a mode setter 62, a reference position setter 63, a ones indicator drive controller 64, a tens indicator drive controller 65, a second hand drive controller 66, and an hour-minute hands drive controller 67.

Based on detection signals output from the operation detector 51, A button switch 52, and B button switch 53, the operation evaluator 61 determines how the user operated the crown 5, A button 6, and B button 7. More specifically, the operation evaluator 61 determines the stop position of the crown 5 (for example, the zero stop, first stop, or second stop), the direction and amount of crown 5 rotation, and how the A button 6 and B button 7 were pushed by the user.

Based on the operation identified by the operation evaluator 61, the mode setter 62 sets the operating mode of the control module 60. For example, if the A button 6 is pushed for a specific time or longer when the crown 5 is at the zero stop, the mode setter 62 selects the reception mode for operating the reception controller 54.

If the crown 5 is pulled out to the second stop and the A button 6 is pushed, the mode setter 62 sets the reference position adjustment mode in which the reference position setter 63 sets the ones date indicator 21 and tens date indicator 22 to the reference positions.

The reference position setter 63 operates when the reference position adjustment mode is set, and executes a process of setting the ones date indicator 21 and tens date indicator 22 to the reference positions.

As described further below, the reference position setting process is a process of precisely adjusting the positions of the date indicators with the crown 5 after moving the ones date indicator 21 to the reference position showing the '1' in the ones window 17, and moving the tens date indicator 22 to the reference position showing the '0' in the tens window 18.

When advancing the date indicators during normal operation (in the normal date advancing process), when adjusting the date to change the displayed date to the current date when a time signal has been received or when resuming normal operation from a power conservation mode, and in the reference position setting process, the ones indicator drive controller 64 outputs drive pulses to the first motor 31 to drive the ones date indicator 21 a specific angle of rotation in the first direction C1 or second direction C2. In this embodiment, when the ones indicator drive controller 64 outputs 102 forward rotation drive pulses to the first motor 31, the ones date indicator 21 turns 36 degrees and the date changes one day.

Similarly to the ones indicator drive controller 64, in the normal date advancing process, current date correction process, and reference position setting process, the tens indicator drive controller 65 outputs drive pulses to the second motor 41 to drive the tens date indicator 22 a specific angle of rotation in the first direction D1 or second direction D2. In this embodiment, when the tens indicator drive controller 65 outputs 198 forward rotation drive pulses to the second motor 41, the tens date indicator 22 turns 90 degrees and the tens digit moves one position.

The second hand drive controller 66 outputs drive pulses to the second hand driver 57, and controls driving the second hand 13. The hour-minute hands drive controller 67 outputs drive pulses to the hour-minute hand driver 58, and controls driving the minute hand 12 and hour hand 11.

Date Indicator Drive Control of the Control Module

Drive control of the ones date indicator 21 by the ones indicator drive controller 64, and drive control of the tens date indicator 22 by the tens indicator drive controller 65, are described next.

Below, the number of drive pulses respectively input to the first motor 31 or second motor 41 to drive the rotor 311 or rotor 411 in the first driving direction C3, D3 is expressed by the directional term 'forward,' the pulse count, and the term 'pulses,' and the number of drive pulses input to drive the rotor 311 or rotor 411 in the second driving direction C4, D4 is expressed by the directional term 'reverse,' the pulse count, and the term 'pulses.' For example, inputting two drive pulses to drive the ones date indicator 21 in the first direction C1 is written '2 forward pulses.'

Of any two meshing wheels in the first wheel train 32 and second wheel train 42, the driving wheel is referred to as drive wheel A, and the driven wheel is referred to as wheel B.

The main cause of the position of the date indicators shifting in the first wheel train 32 and second wheel train 42 due to differences in the direction of rotation of the ones date indicator 21 and tens date indicator 22 is backlash between the first wheel 211, second wheel 221, and pinions 323A and 423A. In this instance, therefore, drive wheels A are pinions 323A and 423A, and wheels B are the first wheel 211 and second wheel 221.

In addition, the drive pulses required to turn drive wheels A sufficiently to compensate for backlash (the backlash amount) are referred to as backlash correction pulses.

In this example, variation (deviation) in the backlash between drive wheel A and wheel B in the first wheel train 32 expressed as the drive pulse count of the first motor 31 is 2.9 pulses for minimum backlash, 6.0 pulses for maximum backlash, and typically (average) 4.2 pulses. Backlash correction in the ones indicator drive mechanism 30 is therefore set to 4 pulses, which is the highest pulse count less than or equal to the typical (average) pulse count. Therefore, if drive pulses equal to half (2 pulses) of the backlash correction pulse count are input to the first motor 31 when the drive wheel A and wheel B are meshed, the tooth of drive wheel A will move to substantially the center between the teeth of wheel B.

Likewise, backlash between drive wheel A and wheel B in the second wheel train 42 is a minimum 4.3 pulses, a maximum 7.3 pulses, and typically (average) 6.4 pulses. Backlash correction is therefore set to 6 pulses. As a result, if drive pulses equal to half (3 pulses) of the backlash correction pulse count are input to the second motor 41 when the drive wheel A and wheel B are meshed, the tooth of drive wheel A will move to substantially the center between the teeth of wheel B.

1-1. Normal Date Advancing Process: Ones Date Indicator

Figures 5A, 5B, 5C:
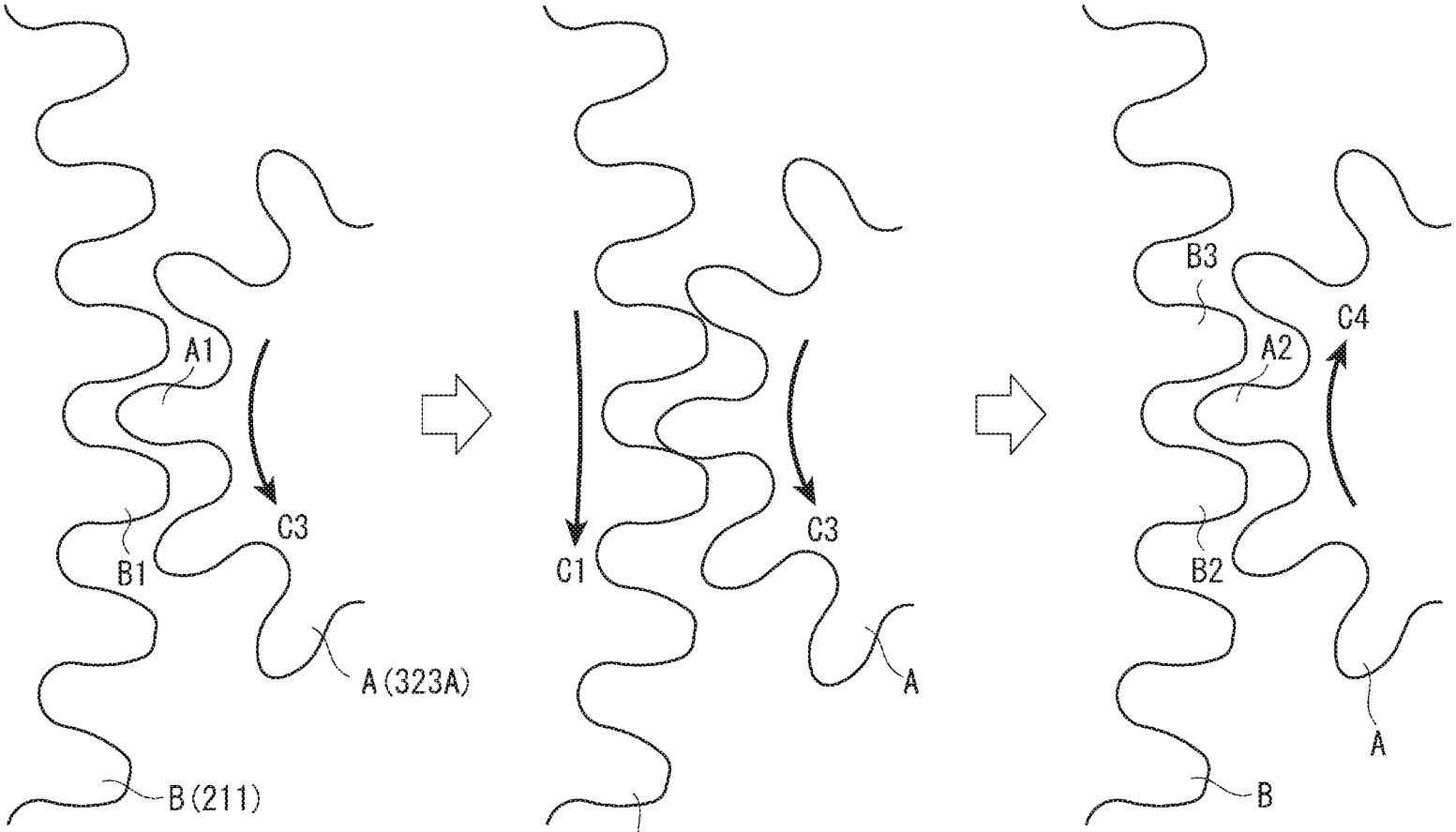
FIG. 5A to FIG. 5C illustrate the first rotation process of the drive wheel and driven wheel of the ones indicator drive mechanism in the normal date advancing process.

When the date changes each day, the ones indicator drive controller 64 controls driving the ones date indicator 21 to turn one day angle (36 degrees) in the first direction C1. As shown in FIG. 5A, the drive wheel A on the drive side (pinion 323A in this example) and the wheel B on the driven side (first wheel 211 in this example) of the first wheel train 32 are disposed with a specific gap between their teeth when in the stationary position before turning. As a result, the ones indicator drive controller 64 outputs drive pulses to turn the drive wheel A to the first motor 31 until tooth A1 of the drive wheel A touches tooth B1 of wheel B. In this embodiment of the invention, the ones indicator drive controller 64 outputs 2 forward pulses (half the backlash correction pulses) as the drive pulses causing the drive wheel A to turn in the first driving direction C3.

As shown in FIG. 5B, the ones indicator drive controller 64 then outputs 102 forward pulses as the drive pulses advancing the ones date indicator 21 one day from the position where the drive wheel A touches wheel B. As a result, the drive wheel A turns in the first driving direction C3, and the ones date indicator 21 turns one day angle (36 degrees) in the first direction C1.

Next, so that a specific gap is maintained between the teeth of the drive wheel A and wheel B, the ones indicator drive controller 64 outputs 2 reverse pulses as the drive pulses to the first motor 31. As a result, the drive wheel A turns an angle approximately one half the backlash amount in the second driving direction C4, tooth A2 of the drive wheel A moves to the midpoint between tooth B2 and tooth B3 of the wheel B where there is a substantially equal gap between the teeth. As a result, because the drive wheel A can only turn to where it touches wheel B in the event a shock to the electronic timepiece 1 causes the ones date indicator 21 to move, deviation in the position of the ones date indicator 21 caused by the impact can be minimized.

1-2. Normal Date Advancing Process: Tens Date Indicator

When the tens digit of the date changes when the date advances during normal operation, that is, when the date changes from 9 to 10, from 19 to 20, and from 29 to 30, and from the last day in the month to 1, the tens indicator drive controller 65 controls driving the tens date indicator 22 to turn a ten day angle (90 degrees) in the first direction D1. Note that the tens date indicator 22 turns 180 degrees only when the date changes from the last day in February to March 1.

Note that because controlling driving the tens indicator drive controller 65 is the same as controlling driving the ones indicator drive controller 64, depiction thereof in the figures and further description thereof is omitted. More specifically, because a specific gap is maintained between the teeth of the drive wheel A on the drive side (pinion 423A in this example) and the wheel B on the driven side (second wheel 221 in this example) when in the stationary position before turning, the tens indicator drive controller 65 outputs 3 forward pulses, which is half the backlash correction pulse count, to the second motor 41, and then outputs 198 forward pulses as the drive pulses, to turn the tens date indicator 22 90 degrees in the first direction D1. After the tens date indicator 22 turns 90 degrees, the tens indicator drive controller 65 outputs 3 reverse pulses, which is half the backlash correction pulse count, as the drive pulses to the second motor 41, causing the drive wheel A to turn in the second driving direction D4 and the tooth of the drive wheel A to be positioned between the teeth of the wheel B. As a result, because the drive wheel A can only turn to where it touches wheel B in the event a shock to the electronic timepiece 1 causes the tens date indicator 22 to move, deviation in the position of the tens date indicator 22 caused by the impact can be minimized.

2. Current Date Correction Process

As described above, the current date correction process is executed when resuming normal operation from the power conservation mode, and when adjusting the date display based on received time information.

The electronic timepiece 1 in this example has a solar cell or other power generating means, and a storage battery or other power storage means to store the power generated by the generating means, and when the generating means stops generating power, or the voltage in the storage means goes below a specific threshold, activates a power conservation function that continues operating the timekeeping circuit 55 to keep the internal time, and stops moving the hands and date indicator. When the power generating means then resumes generating power, or the voltage of the storage means goes above a specific threshold, the power conservation mode is cancelled, the electronic timepiece 1 resumes moving the hands, fast forwards the hour hand 11, minute hand 12, and second hand 13 to indicate the current time, and sets the ones date indicator 21 and tens date indicator 22 to indicate the current date.

Furthermore, when the electronic timepiece 1 acquires the current time by receiving a signal carrying time information, such as when the electronic timepiece 1 moves from Japan to the U.S.A., receives the current time in the United States, and adjusts the current date to the date one day before the displayed date, the ones date indicator 21 and tens date indicator 22 may be moved to show the current date at the current location.

When both the ones date indicator 21 and tens date indicator 22 must be moved to indicate the date, the ones date indicator 21 and tens date indicator 22 may be moved simultaneously. However, to prevent a momentary increase in power consumption, either the ones date indicator 21 or the tens date indicator 22 is moved first, and then the other is moved.

2-1. Current Date Correction Process: Ones Date Indicator

When the ones date indicator 21 must be corrected to adjust the displayed date to the current date, the ones indicator drive controller 64 first determines the direction of rotation requiring the smallest angle of rotation to correctly position the ones date indicator 21.

First Rotation Process

If the angle of rotation is smallest when the ones date indicator 21 turns in the first direction C1, and when the ones date indicator 21 must turn 180 degrees, the ones indicator drive controller 64 controls driving the ones date indicator 21 to turn in the first direction C1. Note that when the ones date indicator 21 turns 180 degrees the angle of rotation is the same whether the ones date indicator 21 turns forward or reverse, but because the first motor 31 consumes less power for forward rotation, the ones indicator drive controller 64 drives the ones date indicator 21 in the first direction C1.

The rotation process in the first direction C1 is the same as in the normal date advancing process described in FIG. 5 except that driving the indicator one day angle (36 degrees) changes to turning the ones date indicator 21 the angle equal to the specified number of days.

That is, the ones indicator drive controller 64 outputs 2 forward pulses as the drive pulses to the first motor 31 to turn the drive wheel A until the tooth of the drive wheel A touches the tooth of wheel B. The ones indicator drive controller 64 then outputs the number of drive pulses required to correct the date indicated by the ones date indicator 21. For example, if the date on the ones date indicator 21 must be advanced two days, the correction amount is 102 forward pulses times 2, and the ones indicator drive controller 64 therefore 204 forward drive pulses.

The ones indicator drive controller 64 then outputs 2 reverse pulses (half the backlash correction pulse count) to the first motor 31. As a result, the drive wheel A turns an angle one half the backlash amount in the second driving direction C4 while wheel B remains stationary, and tooth A2 of the drive wheel A moves to the midpoint between tooth B2 and tooth B3 of the wheel B.

Second Rotation Process

If the angle of rotation (correction amount) is smallest when the ones date indicator 21 turns in the second direction C2 to set the date, the ones indicator drive controller 64 controls driving the ones date indicator 21 to turn a specific angle in the second direction C2.

First, the ones indicator drive controller 64 outputs 2 reverse pulses (half the backlash correction pulse count) as the drive pulses to the first motor 31 to turn the drive wheel A in the second driving direction C4 until the tooth A1 of the drive wheel A touches tooth B1 of wheel B.

Figures 6A, 6B, 6C, 6D:
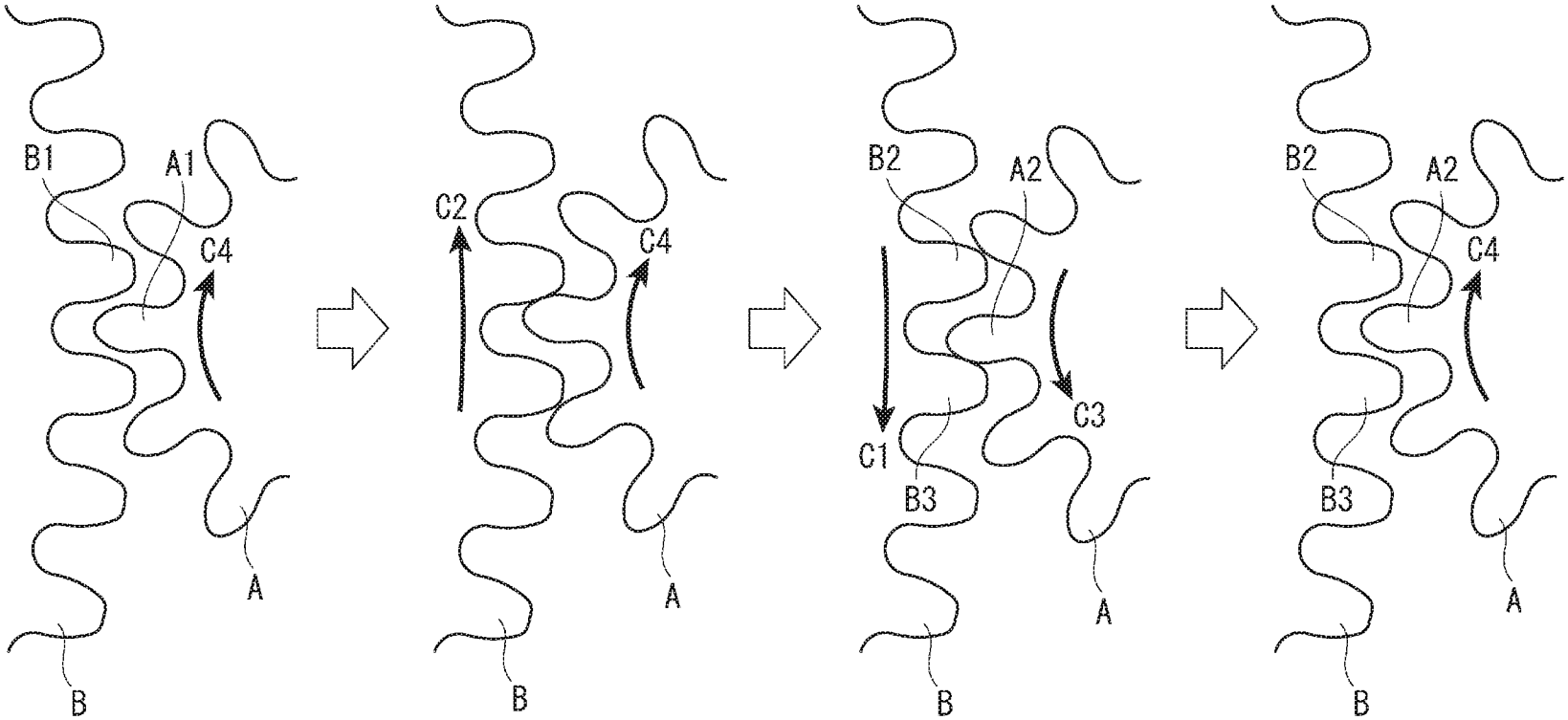
FIG. 6A to FIG. 6D illustrate the second rotation process of the drive wheel and driven wheel of the ones indicator drive mechanism in the current date correction process.

Next, as shown in FIG. 6B, the ones indicator drive controller 64 outputs to the first motor 31 the drive pulse count equal to the number of drive pulses in the second direction C2 required to correct the date indicated by the ones date indicator 21 (102 reverse pulses times the number of days) plus the display correction amount (4 reverse pulses in this example) to compensate for the display offset. For example, if the date must be corrected by 2 days, the ones indicator drive controller 64 outputs (102 reverse pulses times 2)+4 reverse pulses=208 reverse pulses as the number of drive pulses output to the first motor 31. As a result, drive wheel A turns in the second driving direction C4, and the wheel B, that is, the ones date indicator 21, turns the angle (72 degrees) of two days in the second direction C2, plus the angle corresponding to the display offset correction (36×4/102= approximately 1.41 degrees).

To turn the ones date indicator 21 in the first direction C1, the ones indicator drive controller 64 then outputs drive pulses corresponding to the angle of rotation (8 forward pulses) equal to the backlash correction amount (4 forward pulses) plus the display offset compensation (4 forward pulses).

As a result, as shown in FIG. 6C, tooth A2 of drive wheel A that touched tooth B2 of wheel B when turned in the second driving direction C4 moves the backlash correction angle in the first driving direction C3, meshes with tooth B3 of the wheel B, and then moves the backlash correction angle further in the first direction C1. As a result, the ones date indicator 21 also turns in the first direction C1.

Last, as in the first rotation process, the ones indicator drive controller 64 outputs 2 reverse pulses (half the backlash correction count) to the first motor 31. As a result, as shown in FIG. 6D, the drive wheel A turns an angle one half the backlash amount in the second driving direction C4 while wheel B remains stationary, and tooth A2 of the drive wheel A moves to the midpoint between tooth B2 and tooth B3 of the wheel B.

2-2. Current Date Correction Process: Tens Date Indicator

When the tens date indicator 22 must be adjusted to correct the displayed date to the current date, after the ones indicator drive controller 64 finishes the ones date indicator 21 adjustment process, or if correcting the ones date indicator 21 is not necessary, the tens indicator drive controller 65 determines the direction of rotation requiring the smallest amount (angle of rotation) to correctly position the tens date indicator 22.

First Rotation Process

If the angle of rotation is smallest when the tens date indicator 22 turns in the first direction D1, and when the tens date indicator 22 must turn 180 degrees, the tens indicator drive controller 65 executes the same process as the ones indicator drive controller 64 driving in the first direction C1. That is, the tens indicator drive controller 65 controls driving the tens date indicator 22 to turn in the first direction D1. Note that the current date correction process of the tens date indicator 22 is the same as normal date advancing process except that drive control occurs every ten days (90 degrees) or 20 days (180 degrees).

That is, the tens indicator drive controller 65 outputs 3 forward pulses as the drive pulses to the 41 to turn the drive wheel A until the tooth of the drive wheel A touches the tooth of wheel B. The tens indicator drive controller 65 then outputs the number of drive pulses required to correct the date indicated by the tens date indicator 22. For example, if the date on the tens date indicator 22 must be advanced ten days, the correction amount is 198 forward pulses, and if the date on the tens date indicator 22 must be advanced twenty days, the correction amount is 198×2=396 forward pulses.

The tens indicator drive controller 65 then outputs 3 reverse pulses (half the backlash correction pulse count) to the second motor 41. As a result, the drive wheel A turns an angle one half the backlash amount in the second driving direction D4 while wheel B remains stationary, and tooth of the drive wheel A moves to the midpoint between teeth of the wheel B.

Second Rotation Process

If the angle of rotation (correction amount) is smallest when the tens date indicator 22 turns in the second direction D2 to set the date, the tens indicator drive controller 65 controls driving the tens date indicator 22 to turn a specific correction amount in the second direction D2 as described in the second rotation process of the ones date indicator 21 shown in FIG. 6.

First, the tens indicator drive controller 65 outputs 3 reverse pulses (half the backlash correction pulse count) as the drive pulses to the second motor 41 to turn the drive wheel A in the second driving direction D4.

Next, the tens indicator drive controller 65 outputs to the second motor 41 drive pulses of the angle of rotation equal to the drive pulses (198 reverse pulses times a specific number) for driving the tens date indicator 22 only the correction amount in the second direction D2, plus the display correction amount (6 reverse pulses in this example) to compensate for the display offset.

Next, the tens indicator drive controller 65, to turn the tens date indicator 22 in the first direction D1, outputs to the second motor 41 drive pulses of the drive angle (12 forward pulses) equal to the backlash correction amount (6 forward pulses) plus the display correction amount (6 forward pulses).

The tooth of the drive wheel A touching the tooth of the wheel B when turned in the second driving direction D4 moves in the third driving direction D3 due to the backlash correction and meshes with the teeth of the wheel B, and then moves further by the display correction amount in the third driving direction D3. As a result, the tens date indicator 22 also turns in the first direction D1.

Finally, the tens indicator drive controller 65 outputs 3 reverse pulses (half the backlash correction pulse count) as the drive pulses to the second motor 41. As a result, the drive wheel A turns an angle one half the backlash amount in the second driving direction D4 while wheel B remains stationary, and the tooth of the drive wheel A moves to the midpoint between teeth of wheel B.

3. Reference Position Setting Mode Process

When the user executes an operation setting a specific reference position setting mode, the mode setter 62 of the control module 60 changes to a reference position setting mode for adjusting the display positions of the ones date indicator 21 and tens date indicator 22 in the date windows 17 and 18, and activates the reference position setter 63.

Figure 7B:
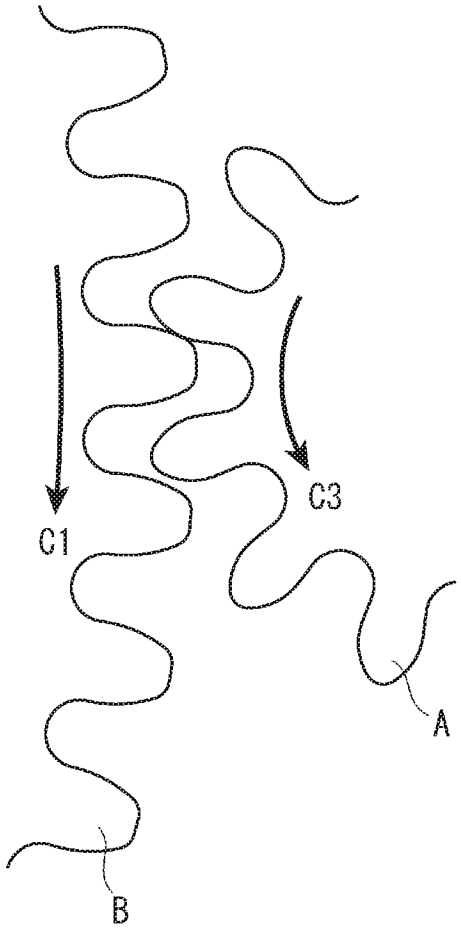
FIG. 7A to FIG. 7B illustrate the first rotation process of the drive wheel and driven wheel of the ones indicator drive mechanism in the reference position alignment mode process.
Figure 7A:
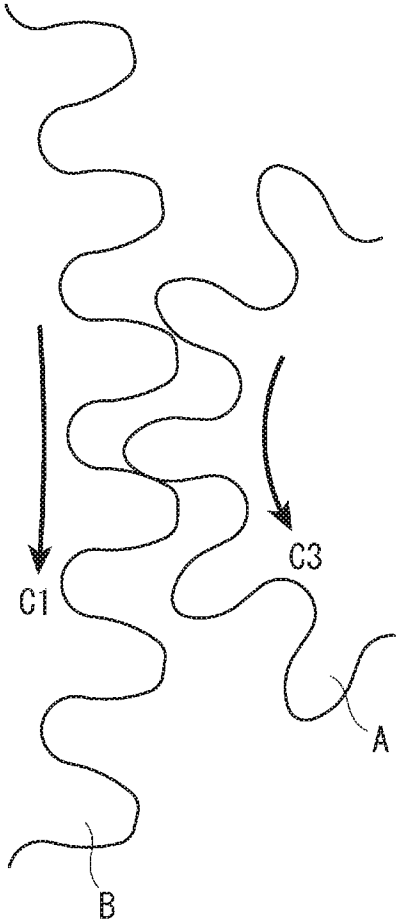

When the operation selecting the reference position setting mode is executed, the reference position setter 63 first controls the ones indicator drive controller 64 and tens indicator drive controller 65 to execute a process moving the ones date indicator 21 and tens date indicator 22 to the set reference positions. More specifically, the ones indicator drive controller 64 turns the ones date indicator 21 in the first direction C1 by the ones indicator drive mechanism 30 until the ones date indicator 21 turns to a previously set reference position. As shown in FIG. 7A, the drive wheel A and wheel B turn in first driving direction C3 or first direction C1 at this time, and when they finish turning to the reference positions, the drive wheel A (pinion 323A, for example) on the drive side of the first wheel train 32 stops in the first driving direction C3 at a position meshed with the driven side wheel B (first wheel 211).

Note that in this embodiment of the invention, as shown in FIG. 8, the position where the number '1' printed on the ones date indicator 21 is displayed from the ones window 17 is set as the reference position of the ones date indicator 21, and the ones indicator drive controller 64 turns the ones date indicator 21 in the first direction C1 to the reference position.

Next, while not shown in the figures, the tens indicator drive controller 65 turns the tens date indicator 22 in the first direction D1 by the tens indicator drive mechanism 40 until the tens date indicator 22 rotates to the previously set reference position. When the tens date indicator 22 stops turning to the reference position, the second wheel train 42 stops with the drive side wheel (pinion 423A in this example) meshed in the third driving direction D3 with the driven side wheel (second wheel 221).

As shown in FIG. 8, the position where the number '0' printed on the tens date indicator 22 is displayed from the tens window 18 is set as the reference position of the tens date indicator 22, and the tens indicator drive controller 65 turns the tens date indicator 22 in the first direction D1 to the reference position.

3-1. Reference Position Setting Mode Process: Ones Date Indicator

When the ones date indicator 21 and tens date indicator 22 turn automatically to the reference positions, the reference position setter 63 executes the reference position setting mode of the ones date indicator 21. As a result, when the user turns the crown 5, the ones indicator drive controller 64 outputs drive pulses to the first motor 31 based on the direction and angle of crown 5 rotation. For example, if the operation detector 51 is configured to detect rotation of the crown 5 each time the crown 5 turns 120 degrees, the ones indicator drive controller 64 outputs 1 forward pulse to the first motor 31 when the crown 5 turns 120 degrees clockwise, and outputs 1 reverse pulse to the first motor 31 when the crown 5 turns 120 degrees counterclockwise.

Because the first motor 31 turns the ones date indicator 21 one day, that is, 36 degrees, when 102 drive pulses are applied, the ones date indicator 21 turns 36 degrees/10=approximately 0.35 degrees when one drive pulse is applied. As a result, the display position of the ones date indicator 21 in relation to the ones window 17 and the tens date indicator 22 can be precisely adjusted.

Reference Position Setting Process in the First Direction

When the user turns the crown 5 clockwise, the ones indicator drive controller 64 outputs 1 forward pulse to the first motor 31 each time the operation detector 51 detects rotation of the crown 5. After turning to the reference position, the drive wheel A is meshed with the wheel B in the first driving direction C3 as shown in FIG. 7A. As a result, when the first motor 31 turns 1 forward drive pulse, the drive wheel A turns in the first driving direction C3 as shown in FIG. 7B, wheel B turns in the first direction C1, and the ones date indicator 21 therefore also turns approximately 0.35 degrees. If the user turns the crown 5 again, the ones date indicator 21 turns approximately 0.35 degrees further. If the user continues turning the crown 5, such as 360 degrees in a single operation, and the operation detector 51 detects three consecutive rotations of the crown 5, the ones indicator drive controller 64 outputs 3 forward drive pulses to the first motor 31, and the ones date indicator 21 turns approximately 1.05 degrees.

Figure 8A:
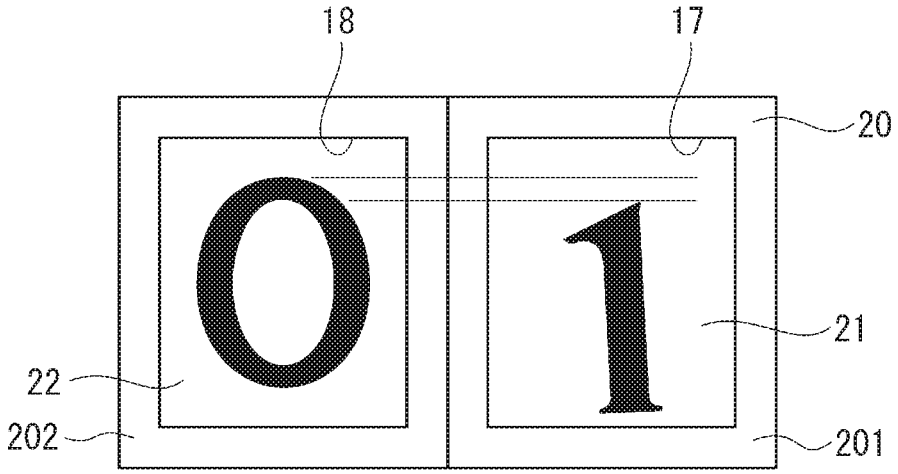
FIG. 8A to FIG. 8B illustrate the first rotation process of the ones indicator in the reference position alignment mode process.
Figure 8B:
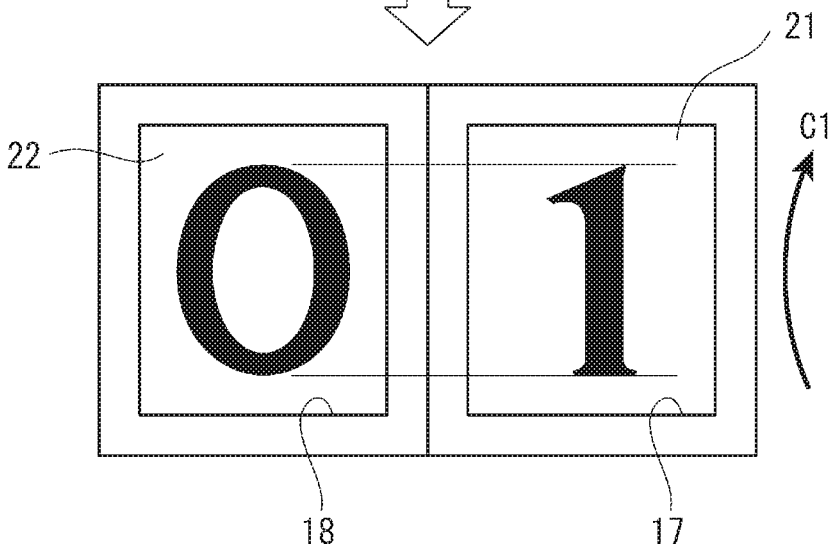

As a result, if the display position of the number '1' on the ones date indicator 21 that moved to the reference position is shifted towards the bottom of the ones window 17 as shown in FIG. 8A, the ones date indicator 21 can be turned sequentially in the first direction C1 by manually turning the crown 5 clockwise to precisely adjust the display position relative to the ones window 17 as shown in FIG. 8B. The display position can therefore be adjusted to match the display position of the adjacent tens date indicator 22, and the height of the date numbers displayed by the ones date indicator 21 and tens date indicator 22 can be matched for a well balanced display.

Reference Position Setting Process in the Second Direction

Figures 9A, 9B, 9C, 9D:
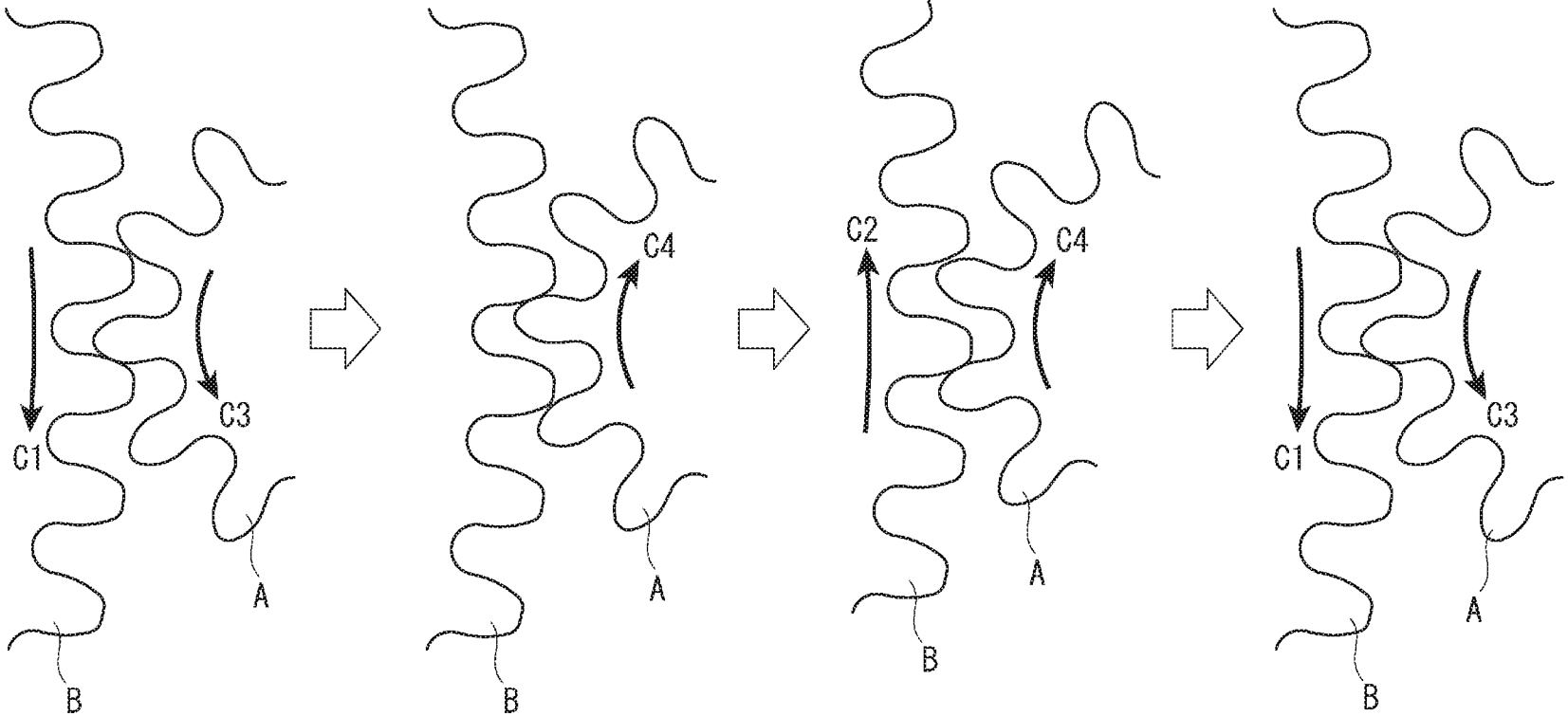
FIG. 9A to FIG. 9D illustrate the second rotation process of the drive wheel and driven wheel of the ones indicator drive mechanism in the reference position alignment mode process.

As shown in FIG. 9A, when the ones date indicator 21 has turned to the reference position, the drive wheel A is meshed with the wheel B in the first driving direction C3. As a result, when the crown 5 turns counterclockwise, the ones indicator drive controller 64 outputs 4 reverse drive pulses to the first motor 31 to first turn the drive wheel A the backlash amount as shown in FIG. 9B. As a result, the drive wheel A turns in the second driving direction C4, and moves to the position meshed with the wheel B.

In addition, the ones indicator drive controller 64 outputs 1 reverse pulse to the first motor 31 each time the operation detector 51 detects rotation of the crown 5. When the first motor 31 turns 1 reverse drive pulse, the drive wheel A turns wheel B in the second direction C2 as shown in FIG. 9C, and the ones date indicator 21 therefore also turns approximately 0.35 degrees in the second direction C2. If the user continues turning the crown 5, such as 360 degrees in a single operation, and the operation detector 51 detects three consecutive rotations of the crown 5, the ones indicator drive controller 64 outputs 3 reverse drive pulses to the first motor 31, and the ones date indicator 21 turns approximately 1.05 degrees in the second direction C2. In other words, if the operation detector 51 detects rotation of the crown 5, and then detects further rotation of the crown 5 in the same direction within a specific period of time, the operation detector 51 determines that the crown 5 was turned continuously and outputs the number of drive pulses corresponding to the total amount of rotation that was detected.

Figure 10A:
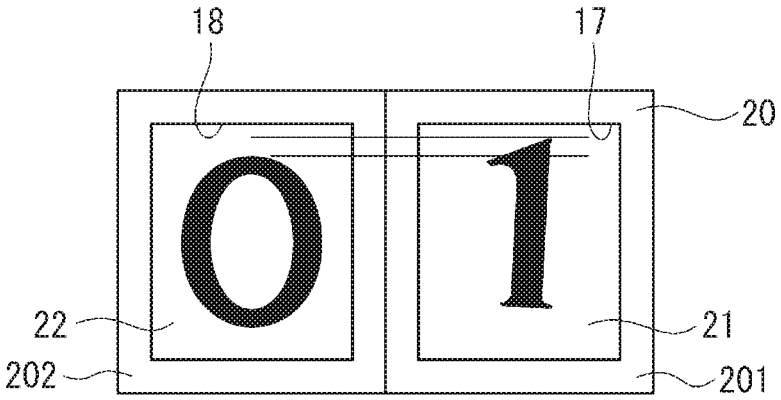
FIG. 10A to FIG. 10D illustrate the second rotation process of the ones indicator in the reference position alignment mode process.
Figure 10B:
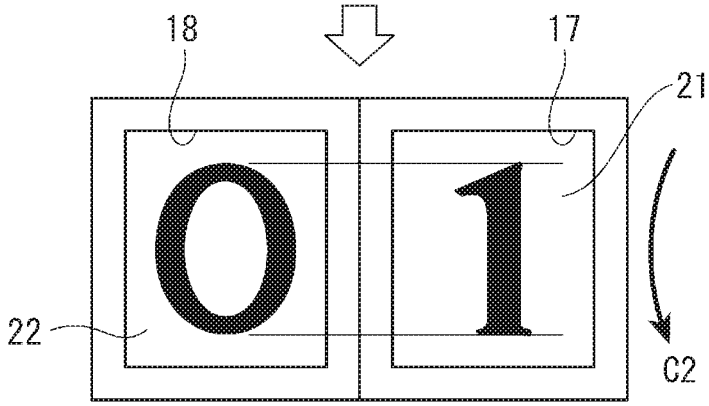

As a result, as shown in FIG. 10A, if the display position of the number '1' on the ones date indicator 21 that moved to the reference position is shifted towards the top of the ones window 17 as shown in FIG. 10A, the ones date indicator 21 can be turned sequentially in the second direction C2 by manually turning the crown 5 counterclockwise to precisely adjust the display position relative to the ones window 17 as shown in FIG. 10B. The display position can therefore be adjusted to match the display position of the adjacent tens date indicator 22, and the height of the date numbers displayed by the ones date indicator 21 and tens date indicator 22 can be matched for a well balanced display.

If the operation detector 51 detects counterclockwise rotation of the crown 5, and then does not detect further rotation of the crown 5 in the same direction within a specific period of time (such as one second), the operation detector 51 determines that rotation of the crown 5 stopped. The ones indicator drive controller 64 therefore outputs drive pulses equal to the display correction amount (4 reverse pulses) to the first motor 31, and the ones date indicator 21 turns a further approximately 1.4 degrees in the second direction C2 as shown in FIG. 10C.

The ones indicator drive controller 64 then outputs drive pulses for an angle of rotation (8 forward pulses) equal to the backlash correction angle (4 forward pulses) plus the display correction amount (4 forward pulses) to the first motor 31. The drive pulses of the backlash correction angle (4 forward pulses) cause the drive wheel A to turn in the first driving direction C3 and mesh with the wheel B as shown in FIG. 9D. Because the drive pulses of the display correction amount (4 forward pulses) cause the drive wheel A to turn further in the first driving direction C3, and wheel B and the ones date indicator 21 to turn in the first direction C1 as shown in FIG. 10D, the ones date indicator 21 turns approximately 1.4 degrees in the first direction C1, returning to the position shown in FIG. 10B.

Because the ones date indicator 21 is thus driven in the first direction C1 to complete the reference position setting when the crown 5 is turned counterclockwise, the effect of backlash due to differences in the direction of rotation can be eliminated.

Figure 10C:
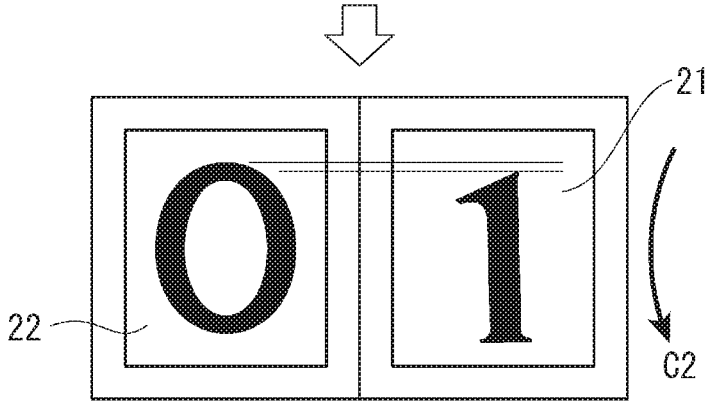
Figure 10D:
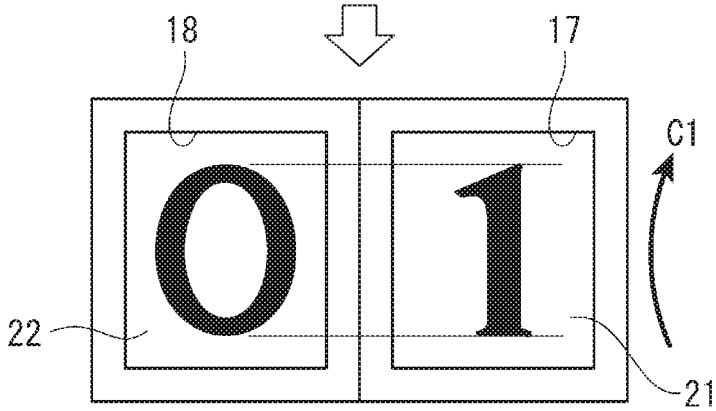

Note that the process illustrated in FIG. 10C and FIG. 10D, that is, the process of turning the ones date indicator 21 additionally in the second direction C2 after tuning the display position of the ones date indicator 21, and then resetting the ones date indicator 21 in the first direction C1, is executed each time rotation of the crown 5 is determined to have stopped. For example, if the crown 5 is turned one revolution at an interval of one second or more, a process of outputting 1 reverse pulse for adjustment, then outputting drive pulses of the display correction amount (4 reverse pulses) to turn the ones date indicator 21 in the second direction C2, and then outputting drive pulses for backlash correction (4 forward pulses) and the display correction amount (4 forward pulses) to return the ones date indicator 21 in the first direction C1, is repeated.

Ending the Reference Position Setting Process

The reference position setting process of the ones date indicator 21 in the first direction C1 or second direction C2 ends when the user pushes the B button 7 to change to the reference position setting process of the tens date indicator 22, or when the user pushes the crown 5 in to the first stop or zero stop position. When this happens, the reference position setter 63 stores the reference position of the ones date indicator 21 (the position of the number '1') in the storage 56, which is nonvolatile memory in this example. More specifically, the reference position of the ones date indicator 21 can be manually set by the user operating the crown 5, and position information indicating this reference position is stored in storage 56. As a result, the next time the reference position setting process executes, the reference position to which the ones indicator drive controller 64 first moves the ones date indicator 21 automatically is the position stored in the storage 56.

When the reference position setting process of the ones date indicator 21 ends, the ones indicator drive controller 64 outputs 2 reverse drive pulses to the first motor 31, and turns the drive wheel A half the backlash correction amount in the second direction C2. As a result, the drive wheel A stops at the position shown in FIG. 5C, that is, with a tooth of the drive wheel A centered between teeth of wheel B.

3-2. Reference Position Setting Mode Process: Tens Date Indicator

When a specific operation is performed after setting the reference position setting mode, such as pushing the B button 7, operation goes from the reference position setting mode for the ones date indicator 21 to the reference position setting mode for the tens date indicator 22.

As a result, when the user turns the crown 5, the tens indicator drive controller 65 outputs drive pulses to the second motor 41 based on the direction and angle of crown 5 rotation. For example, the tens indicator drive controller 65 outputs 1 forward pulse to the second motor 41 when the crown 5 turns 120 degrees clockwise, and outputs 1 reverse pulse to the second motor 41 when the crown 5 turns 120 degrees counterclockwise.

Because the second motor 41 turns the tens date indicator 22 ten days, that is, 90 degrees, when 198 drive pulses are applied, the tens date indicator 22 turns 90 degrees/198=approximately 0.45 degrees when one drive pulse is applied. As a result, the display position of the tens date indicator 22 in relation to the tens window 18 and the ones date indicator 21 can be precisely adjusted.

The reference position setting process of the tens date indicator 22 in response to crown 5 operation is the same as the reference position setting process of the ones date indicator 21 described above, and further description thereof is omitted.

Reference Position Setting Process in the First Direction

When the user turns the crown 5 clockwise, the tens indicator drive controller 65 outputs 1 forward pulse to the second motor 41 each time the operation detector 51 detects rotation of the crown 5. When the second motor 41 turns 1 forward drive pulse, the tens date indicator 22 turns approximately 0.45 degrees. If the user continues turning the crown 5, the tens indicator drive controller 65 outputs multiple forward drive pulses according to how far the crown 5 is turned, and the tens date indicator 22 turns in the first direction D1 according to the number of drive pulses applied.

Reference Position Setting Process in the Second Direction

When the crown 5 turns counterclockwise, the tens indicator drive controller 65 outputs drive pulses equal to the backlash correction amount (6 reverse drive pulses) to the second motor 41. As a result, the drive wheel A turns in the second direction D2, and moves to the position meshed with the wheel B.

Each time the operation detector 51 detects further rotation of the crown 5, the tens indicator drive controller 65 outputs 1 reverse drive pulse to the second motor 41, and the tens date indicator 22 turns in the second direction D2 another approximately 0.45 degrees. If the user continues turning the crown 5, the tens indicator drive controller 65 outputs multiple reverse drive pulses according to how far the crown 5 is turned, and the tens date indicator 22 turns in the second direction D2 according to the number of drive pulses applied.

If the operation detector 51 detects counterclockwise rotation of the crown 5, and then does not detect further rotation of the crown 5 in the same direction within a specific period of time (such as one second), the operation detector 51 determines that rotation of the crown 5 stopped. The tens indicator drive controller 65 therefore outputs drive pulses equal to the display correction amount (6 reverse pulses) to the second motor 41, and the tens date indicator 22 turns approximately 2.7 degrees in the second direction D2.

The tens indicator drive controller 65 then outputs drive pulses equal to the backlash correction angle (6 forward pulses) plus the display correction amount (6 forward pulses) to the second motor 41. The drive pulses of the backlash correction amount (6 forward pulses) cause the drive wheel A to turn in the first direction D1 and mesh with the wheel B. The drive pulses of the display correction amount (6 forward pulses) cause the drive wheel A to turn in the first direction D1, and the tens date indicator 22 turns approximately 2.7 degrees in the first direction D1.

Because the tens date indicator 22 is thus driven in the first direction D1 to complete the reference position setting when the crown 5 is turned counterclockwise, the effect of backlash due to differences in the direction of rotation can be eliminated.

Ending the Reference Position Setting Process

The reference position setting process of the tens date indicator 22 in the first direction D1 or second direction D2 ends when the user pushes the B button 7 to change to the reference position setting process of the ones date indicator 21, or when the user pushes the crown 5 in to the first stop or zero stop position. When this happens, the reference position setter 63 stores the reference position of the tens date indicator 22 (the position of the number '0') in the storage 56, which is nonvolatile memory in this example.

When the reference position setting process of the tens date indicator 22 ends, the tens indicator drive controller 65 outputs 3 reverse drive pulses to the second motor 41, and turns the drive wheel A half the backlash correction amount in the second direction D2. As a result, the drive wheel A stops with a tooth of the drive wheel A centered between teeth of wheel B.

Operating Effect

The operating effects of the foregoing embodiment are described below.

In a second rotation process that turns the ones indicator drive mechanism 30, tens indicator drive mechanism 40, ones date indicator 21, and tens date indicator 22 in the second direction C2, D2, the ones date indicator 21 and tens date indicator 22 turn first in the second direction C2, D2, and are then turned in the first direction C1, D1 to end the process. As a result, because both the first rotation process that turns the ones date indicator 21 and tens date indicator 22 in the first direction C1, D1, and the second rotation process end with rotation in the first direction, deviation in the display positions of the ones date indicator 21 and tens date indicator 22 due to differences in the direction of rotation resulting from the effects of backlash in the first wheel train 32 and second wheel train 42 can be prevented. As a result, whether the ones date indicator 21 and tens date indicator 22 turn in the first direction D1 or the second direction D2, deviation in the display position relative to the date windows 17 and 18 can be prevented.

This embodiment of the invention enables providing a big date complication that displays the date with two date wheels, the ones date indicator 21 and tens date indicator 22, and can also eliminate deviation in the display position of the two numbers shown by the two indicators 21 and 22. As a result, the two numbers indicating a single date can be shown precisely aligned, and the electronic timepiece 1 can be given a luxury timepiece appearance. More specifically, because the user reads the two numbers indicated by the two indicators 21 and 22 as a single date, any deviation in the display position of the two numbers is conspicuous, and detracts from the appearance of the electronic timepiece 1. However, because this embodiment of the invention can prevent deviation in the display positions of the date numerals, the electronic timepiece 1 can be given the look of a luxury watch.

Because there is a reference position adjustment mode enabling the user to precisely adjust the display positions of the ones date indicator 21 and tens date indicator 22 by operating the crown 5, the date can be displayed at the position desired by the user in the date windows 17 and 18, and the electronic timepiece 1 is easier to use.

Furthermore, because a first rotation process and a second rotation process can be executed to adjust the reference positions of the indicators 21 and 22, the reference positions can be adjusted more quickly than if the indicators 21 and 22 can only be turned in one direction for adjustment. Furthermore, because the first rotation process and a second rotation process can be executed when adjusting the reference positions, the display positions can be prevented from shifting due to backlash when the indicators 21 and 22 are turned in the first direction C1, D1 to adjust the reference positions, and when the indicators 21 and 22 are turned in the second direction C2, D2 for adjustment.

In addition, because the indicators 21 and 22 are turned in the second direction C2, D2 an amount corresponding to how far the crown 5 is turned when the user turns the crown 5 continuously in the reference position adjustment process, are then turned the display correction amount in the second direction C2, D2 after operation stops, and are then returned in the first direction C1, D1, the process of returning the indicators 21 and 22 in the first direction C1, D1 can be minimized, and power consumption can be reduced.

Furthermore, because the current date correction process that resets the ones date indicator 21 and tens date indicator 22 to the current date after a time information signal is received and when resuming normal operation from a power conservation mode turns the ones date indicator 21 and tens date indicator 22 in the direction requiring the smallest amount of adjustment, power consumption can be reduced when adjusting the ones date indicator 21 and tens date indicator 22, and less time is required for adjustment.

In the second rotation process, the indicators 21 and 22 turn in the second direction C2, D2 to the adjustment position, then turn the display correction amount in the second direction C2, D2, and then turn in the first direction C1, D1 an amount equal to the backlash correction distance plus the display correction amount. As a result, the positions of the indicators 21 and 22 can be adjusted to also compensate for backlash that depends on the direction of rotation, and the positions of the indicators 21 and 22 can be precisely adjusted both when the indicators 21 and 22 turn in the first direction C1, D1 and when they turn in the second direction C2, D2.

In addition, because rotation equal to the sum of the backlash correction amount and the display correction amount is set to an amount greater than the maximum backlash, the indicators 21 and 22 can be reliably turned in the first direction C1, D1 or second direction C2, D2 by the display correction amount even if backlash varies.

Furthermore, because the drive wheel A is turned in the second driving direction C4, D4 by half the backlash correction pulse count after the first rotation process and second rotation process ends, a tooth of the drive wheel A can be positioned midway between teeth of wheel B. As a result, when the gap between the teeth of the drive wheel A and wheel B is approximately half the backlash amount, offset in the display position can be reduced even if the indicators 21 and 22 turn in the first or second direction in response to a shock to the electronic timepiece 1.

The first rotation process and second rotation process of the ones indicator drive mechanism 30 and tens indicator drive mechanism 40 can be executed easily by controlling the number of drive pulses applied to the first motor 31 and second motor 41.

Other Embodiments

The invention is not limited to the embodiments described above, and can be varied in many ways without departing from the scope of the accompanying claims.

For example, a configuration that enables moving only one of the ones date indicator 21 and tens date indicator 22 in the first direction and second direction is conceivable. For example, the tens date indicator 22 may be configured to turn only in the first direction D1, and the ones date indicator 21 may be configured to turn in both directions and execute the first rotation process and the second rotation process.

Furthermore, a configuration that executes a process turning the drive wheel A half the backlash correction pulse count in the second driving direction C4, D4 after the first rotation process ends and after the second rotation process ends is also conceivable. More specifically, the electronic timepiece 1 may execute the first rotation process and second rotation process when turning the ones date indicator 21 and tens date indicator 22 without also executing the process that positions a tooth of the drive wheel A between teeth of wheel B.

The embodiment described above is configured to execute the first rotation process and second rotation process during the current date correction process and the reference position setting mode, but the first rotation process and second rotation process may be executed only in the reference position setting mode. This is because the ones indicator drive controller 64 and tens indicator drive controller 65 automatically turn the ones date indicator 21 and tens date indicator 22 in the current date correction process, and the ones date indicator 21 and tens date indicator 22 turning in only the first direction imposes no burden on the user.

The electronic timepiece 1 may also be configured without a reference position setter 63, and the user being unable to adjust the reference position. In this case, the display positions of the ones date indicator 21 and tens date indicator 22 may be adjusted in the factory, for example. More specifically, because the first rotation process and second rotation process of the invention can be used in the current date correction process, the first rotation process and second rotation process can also be applied to an electronic timepiece not having a reference position adjustment mode.

The operating means for turning the ones date indicator 21 and tens date indicator 22 is also not limited to the crown 5, and A button 6 and B button 7 may be used. For example, pushing the A button 6 may cause the ones date indicator 21 and tens date indicator 22 to turn in the first direction C1, D1, and pushing the B button 7 may cause the indicators 21 and 22 to turn in the second direction C2, D2. Further alternatively, a configuration that drives the indicators 21 and 22 continuously when the A button 6 or B button 7 is pushed and held depressed is also conceivable.

The configurations of the ones date indicator 21 described as a first display wheel, and the tens date indicator 22 described as a second display wheel, are also not limited to the embodiment described above. For example, the tens date indicator 22 may have two sets of the digits 0 to 3 (8 total digits), and substantially the same diameter as the ones date indicator 21.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

The entire disclosure of Japanese Patent Application No. 2017-147699, filed Jul. 31, 2017 is expressly incorporated by reference herein.

What is claimed is:

1. An electronic timepiece comprising:

a first display wheel having numerals indicating a ones digit of a date;

a second display wheel having numerals indicating a tens digit of the date;

a first drive mechanism configured to turn the first display wheel;

a second drive mechanism configured to turn the second display wheel; and a controller configured to control the first drive mechanism and second drive mechanism;

the first drive mechanism or second drive mechanism configured to turn the display wheel in a first direction and a second direction that is the reverse of the first direction; and the controller, when turning the display wheel in the first direction, executing a first rotation process of turning the display wheel in the first direction and then stopping rotation of the display wheel, and when turning the display wheel in the second direction, executing a second rotation process of turning the display wheel in the second direction, then turning the display wheel in the first direction, and then stopping rotation of the display wheel.

2. The electronic timepiece described in claim 1, wherein:

the first drive mechanism or the second drive mechanism has a driving wheel that meshes with a wheel disposed to the display wheel;

the driving wheel, when turning in a first driving direction, causing the display wheel to turn in the first direction, and when turning in a second driving direction, causing the display wheel to turn in the second direction; and the controller, when executing the second rotation process, causing the driving wheel to turn in the second driving direction an amount of rotation equal to a correction amount required to turn the driving wheel and adjust a display by the display wheel, plus a display correction amount required to compensate for variation of backlash, and then causing the driving wheel to turn in the first driving direction an amount of rotation equal to a backlash correction amount plus the display correction amount, the backlash correction amount being set based on backlash between a wheel of the display wheel and the driving wheel, and the display correction amount being set so the amount of rotation equal to the backlash correction amount plus the display correction amount is greater than the maximum backlash.

3. The electronic timepiece described in claim 2, wherein:

the controller, after ending the first rotation process or ending the second rotation process, causing the driving wheel to turn half the backlash correction amount in the second driving direction.

4. The electronic timepiece described in claim 1, further comprising:

an operating member;

the controller configured to execute a reference position adjustment mode adjusting a reference position of the first display wheel or the second display wheel; and the first drive mechanism or the second drive mechanism, when in the reference position adjustment mode, executing the first rotation process or the second rotation process, and adjusting the reference position of the display wheel, based on operation of the operating member.

5. The electronic timepiece described in claim 1, wherein:

the first drive mechanism is configured to turn the first display wheel in the first direction and the second direction;

the second drive mechanism is configured to turn the second display wheel in the first direction and the second direction; and the controller, when adjusting the date indicated by the first display wheel and the second display wheel to the current date, determines the adjustment direction requiring the first display wheel or second display wheel to turn the smallest amount, executes the first rotation process if the adjustment direction is the first direction, and executes the second rotation process if the adjustment direction is the second direction.

6. The electronic timepiece described in claim 1, wherein:

the first drive mechanism includes a first stepper motor and a first wheel train;

the second drive mechanism includes a second stepper motor and a second wheel train; and the controller outputs a drive pulse to the first or second stepper motor to execute the first rotation process and the second rotation process.

* * * * *